US008494405B2

(12) United States Patent
Kim

(10) Patent No.: US 8,494,405 B2
(45) Date of Patent: Jul. 23, 2013

(54) IMAGE FORMING APPARATUS HAVING CLEANING BLADE AND METHOD OF CONTROLLING THE SAME

(75) Inventor: Jung-woo Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 322 days.

(21) Appl. No.: 12/926,055

(22) Filed: Oct. 22, 2010

(65) Prior Publication Data

US 2011/0255896 A1 Oct. 20, 2011

(30) Foreign Application Priority Data

Apr. 15, 2010 (KR) ..... 10-2010-0034934

(51) Int. Cl.
*G03G 15/16* (2006.01)
*G03G 15/01* (2006.01)

(52) U.S. Cl.
USPC ..... 399/101; 399/302; 399/308

(58) Field of Classification Search
USPC ..... 399/101, 302, 308
See application file for complete search history.

(56) References Cited

U.S. PATENT DOCUMENTS 7,738,807 B2 * 6/2010 Inada et al.
7,894,759 B2 * 2/2011 Yagi ..... 399/302
2004/0234281 A1 * 11/2004 Yoshida et al.
2006/0204272 A1 * 9/2006 Ikeda et al. ..... 399/101
2009/0087206 A1 * 4/2009 Koide et al.
2009/0324279 A1 12/2009 Miyahara et al.

FOREIGN PATENT DOCUMENTS

JP 9-211924 8/1997
JP 2001-350384 12/2001
JP 2003241530 A * 8/2003
JP 2005338709 A * 12/2005

OTHER PUBLICATIONS

European Search Report mailed Aug. 30, 2011 in correspondence with European Patent Application No. 10192436.3.

* cited by examiner

*Primary Examiner* — Susan Lee
(74) *Attorney, Agent, or Firm* — Staas & Halsey LLP

(57) ABSTRACT

An image forming apparatus including: an image carrying member supported in a body housing and forming a visible image by a developing agent; a transfer unit including a driving roller supported in the body housing and an intermediate transfer belt rotated by the driving roller in a first direction on which the visible image on the image carrying member is intermediately transferred to when a printing process is conducted on a recording medium; a cleaning blade in contact with the intermediate transfer belt to clean a remaining developing agent on the intermediate transfer belt rotating in the first direction; the intermediate transfer belt being rotated in an opposite direction to the first direction, for a preset period of time before the visible image is intermediately transferred and rotating the intermediate transfer belt in the first direction so that the visible image is intermediately transferred when the printing process starts.

10 Claims, 6 Drawing Sheets

IMAGE FORMING APPARATUS HAVING CLEANING BLADE AND METHOD OF CONTROLLING THE SAME

CROSS-REFERENCE TO RELATED APPLICATIONS

This application claims priority from Korean Patent Application No. 10-2010-0034934, filed on Apr. 15, 2010 in the Korean Intellectual Property Office, the disclosure of which is incorporated herein by reference.

BACKGROUND

1. Field

Apparatuses and methods consistent with the exemplary embodiments relate to an image forming apparatus which forms an image on a recording medium with a developing agent, and a method of controlling the same, and more particularly, to an image forming apparatus which has a structure in which a remaining developing agent on the transfer unit is cleaned by a cleaning blade and a method of controlling the same.

2. Description of the Related Art

An image forming apparatus is a device which forms a visible image on a recording medium with a developing agent or ink and generally realized as a printer, a copy machine, a fax, a multifunctional device, etc. Here, in the case of forming an image using a developing agent, the image forming apparatus employs various methods to transfer a visible image by the developing agent to a recording medium. For example, a plurality of image carrying members to form a visible image are provided by colors, and visible images on the respective image carrying members are transferred in an overlapped state to a transfer unit, which is referred to as a single-pass method. Further, a single image carrying member is provided, and a process of transferring a visible image from the image carrying member to a transfer unit is sequentially conducted by colors, which is called a multi-pass method.

In the transfer unit of the image forming apparatus, a cleaning blade is installed to clean a remaining developing agent which is not transferred to a recording medium.

In a multi-pass image forming apparatus, a cycle of transferring a visible image from an image carrying member to a transfer unit is performed by colors. Thus, a cleaning blade is not in contact with the transfer unit while an intermediate transfer process is conducted, and cleans a remaining developing agent by contacting with the transfer unit when every color of visible images are intermediately transferred to the transfer unit and finally to a recording medium.

Unlike the multi-pass method, in a single-pass image forming apparatus, however, visible images by colors are intermediately transferred to a transfer unit during one cycle, and thus a cleaning blade always keeps in contact with the transfer unit.

However, in an image forming apparatus in which a transfer unit includes an intermediate transfer belt rotating in a certain direction, and a cleaning blade is provided to be in contact with the intermediate transfer belt, when the cleaning blade keeps in contact with the intermediate transfer belt, it may adhere delicately to the intermediate transfer belt while the image forming apparatus does not conduct a printing process. Alternatively, part of a contact portion of the cleaning blade may be rolled in the rotation direction of the intermediate transfer belt.

If the transfer unit starts operating in this state, the cleaning blade may be bent in the rotation direction of the intermediate transfer belt as the intermediate transfer belt rotates. Accordingly, the cleaning blade has trouble cleaning a remaining developing agent on the intermediate transfer belt, causing deterioration of the quality of image formed on a recording medium.

SUMMARY

Accordingly, one or more exemplary embodiments provide an image forming apparatus in a single-pass method and with a structure in which a cleaning blade keeps in contact with an intermediate transfer belt which prevents a phenomenon that the cleaning blade is bent in a direction of the intermediate transfer belt rotating to have trouble cleaning a remaining developing agent when conducting a printing process, and a method of controlling the same.

The foregoing and/or other aspects may be achieved by providing an image forming apparatus including: a body housing; an image carrying member supported in the body housing and forming a visible image by a developing agent; a transfer unit including a driving roller supported in the body housing and an intermediate transfer belt rotated by the driving roller in a first direction and which the visible image on the image carrying member is intermediately transferred to when a printing process is conducted on a recording medium; a cleaning blade having an end portion keeping in contact with the intermediate transfer belt and cleaning a remaining developing agent on the intermediate transfer belt rotating in the first direction; a drive unit rotatively driving the driving roller; and a control unit controlling the drive unit to rotate the intermediate transfer belt in an opposite direction to the first direction, i.e., a second direction, for a preset period of time before the visible image is intermediately transferred and to rotate the intermediate transfer belt in the first direction so that the visible image is intermediately transferred when the printing process starts.

The cleaning blade may keep in contact with the intermediate transfer belt regardless of whether the printing process is conducted.

The preset period of time may be provided so that at least part of the end portion of the cleaning blade is released from an adhesion state to the intermediate transfer belt.

The preset period of time may be provided so that the end portion of the cleaning blade is restored to the original shape from the state that at least part of the end portion of the cleaning blade is rolled to the intermediate transfer belt in the first direction.

The printing process may be carried out on a plurality of recording media, and the control unit may rotate the intermediate transfer belt in the second direction when the printing process is carried out on a number of sheets of recording media corresponding to a cycle among a total sheets of the recording media.

A plurality of image carrying members may be provided by colors, and visible images by colors on the respective image carrying members may be sequentially overlapped on the intermediate transfer belt to form a color visible image in the printing process.

Another aspect may be achieved by providing a method of controlling an image forming apparatus, the image forming apparatus including: a transfer unit including a driving roller and an intermediate transfer belt rotated by the driving roller in a first direction and which a visible image on an image carrying member is intermediately transferred to when a printing process is conducted on a recording medium; and a cleaning blade having an end portion keeping in contact with the intermediate transfer belt and cleaning a remaining developing agent on the intermediate transfer belt rotating in the first direction, and the method including: rotating the intermediate transfer belt in an opposite direction to the first direction, i.e., a second direction, for a preset period of time before the visible image is intermediately transferred when the printing process starts; and conducting the printing process by rotating the intermediate transfer belt in the first direction so that the visible image is intermediately transferred.

The cleaning blade may keep in contact with the intermediate transfer belt regardless of whether the printing process is conducted.

The preset period of time may be provided enough that at least part of the end portion of the cleaning blade is released from an adhesion state to the intermediate transfer belt The preset period of time may be provided enough that the end portion of the cleaning blade is restored to the original shape from the state that at least part of the end portion of the cleaning blade is rolled to the intermediate transfer belt in the first direction.

The printing process may be carried out on a plurality of recording media, and the rotating the intermediate transfer belt in the second direction may include rotating the intermediate transfer belt in the second direction when the printing process is carried out on a number of sheets of recording media corresponding to a cycle among a total sheets of the recording media.

A plurality of image carrying members may be provided by colors, and the conducting the printing process may include forming a color visible image by sequentially overlapping visible images by colors on the respective image carrying members on the intermediate transfer belt.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
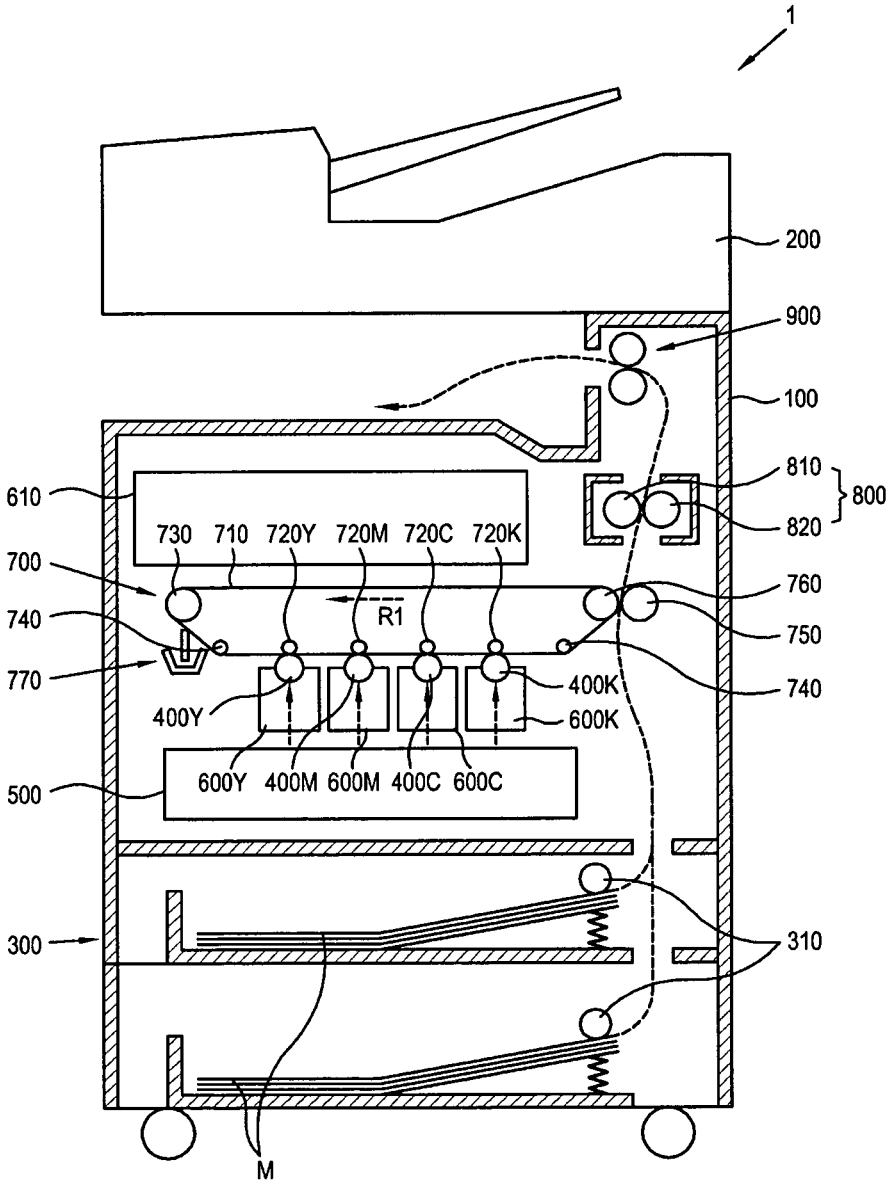
FIG. 1 is a lateral cross-sectional view of an image forming apparatus according to one exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 is a lateral cross-sectional view of an image forming apparatus 1 according to one exemplary embodiment.

As shown in FIG. 1, the image forming apparatus 1 according to the present embodiment is explained as a copier capable of generating color images, but the scope of the present inventive concept may be applicable to a printer, a multi-function printer (MFP), etc., which form images on a recording medium. However, according to the present embodiment, the image forming apparatus 1 is realized in a single-pass method which involves a plurality of image carrying members 400Y, 4000M, 400C, and 400K corresponding to respective colors of developing agents.

The image forming apparatus 1 of the present embodiment includes a body housing 100 forming an outward appearance of the apparatus, a scanning unit 200 scanning a document to obtain a scanned image, a paper feeing unit 300 picking up and providing a piece of a recording medium (M), an image forming unit forming an image on a recording medium (M) provided from the paper feeding unit 300 with a developing agent, a fixing unit 800 fixing an image on a recording medium (M) by heat and pressure, and a paper discharging unit 900 discharging a recording medium (M) on which an image is fixed out of the body housing 100.

The image forming unit includes an image carrying member 400Y, 400M, 400C, and 400K forming an electrostatic latent image and a visible image thereon, an exposure unit 500 exposing the image carrying member 400Y, 400M, 400C, and 400K to form an electrostatic latent image, a developing unit 600Y, 600M, 600C, and 600K providing a developing agent to an electrostatic latent image of the image carrying member 400Y, 400M, 400C, and 400K to form a visible image, and a transfer unit 700 transferring a visible image of the image carrying member 400Y, 400M, 400C, and 400K to a recording medium (M) in an intermediate transfer type.

Hereinafter, each component is explained.

The scanning unit 200 scans a document to generate a scanned image of the document. The scanning unit 200 is implemented in a hybrid method, allowing scanning a document which is fixed in position or a document being transferred. The scanning unit 200 transfers a generated scanned image to the image forming unit to form into an image on a recording medium (M) or to a host (not shown) connected locally or through a network with the image forming apparatus 1.

The paper feeding unit 300 holds a plurality of recording media (M), and when a printing process starts, the paper feeding unit 300 picks up a piece of paper among the recording media (M) loaded using a pickup roller 310 and transfers it to the image forming unit. The paper feeding unit 300 includes a plurality of places to load recording media (M) in and a plurality of pickup rollers 110 corresponding thereto, thereby selectively providing recording media (M) in each place. The paper feeding unit 300 may be installed in the body housing 100 or provided as an option box combined with an outside of the body housing 100 to feed a recording medium (M) into the body housing 100.

The image carrying members 400Y, 400M, 400C, and 400K are realized as a photosensitive body which is capable of forming a potential difference on the surface by electric charge and exposure. In the single-pass method, a plurality of image carrying members 400Y, 400M, 400C, and 400K of different colors are provided and disposed parallel with each other. According to the present embodiment, the image carrying members 400Y, 400M, 400C, and 400K correspond to four colors, respectively, i.e., yellow, magenta, cyan, and black.

The image carrying members 400Y, 400M, 400C, and 400K form an electrostatic latent image based on an image data by each color thereon by the exposure unit 500. When supplying a developing agent to the electrostatic latent image, the developing agent is selectively attached to the surface of the image carrying members 400Y, 400M, 400C, and 400K according to a potential difference, so that the image carrying members 400Y, 400M, 400C, and 400K form a visible image thereon by the developing agent.

The exposure unit 500 radiates a light beam onto the image carrying members 400Y, 400M, 400C, and 400K uniformly charged on the basis of an image data by each color, thereby forming an electrostatic latent image on the image carrying members 400Y, 400M, 400C, and 400K. The exposure unit 500 may be realized as a light scanning unit which includes a light source (not shown), a polygon lens (not shown), and a variety of optical lenses (not shown).

A plurality of developing units 600Y, 600M, 600C, and 600K are installed to correspond to the image carrying members 400Y, 400M, 400C, and 400K by colors, respectively. The developing units 600Y, 600M, 600C, and 600K store developing agents by colors therein and provide them to the image carrying members 400Y, 400M, 400C, and 400K, respectively, to form visible images by colors on the respective image carrying members 400Y, 400M, 400C, and 400K.

The developing units 600Y, 600M, 600C, and 600K are provided with a developing agent container 610 to supply a developing agent to the developing units 600Y, 600M, 600C, and 600K as a developing agent stored in the developing units 600Y, 600M, 600C, and 600K is consumed. Further, the developing units 600Y, 600M, 600C, and 600K may be realized by a cartridge which is detachable from the body housing 100 to be replaceable.

The transfer unit 700 intermediately transfers visible images by colors on the image carrying members 400Y, 400M, 400C, and 400K to overlap with each other at first and then finally transfers the intermediately transferred visible images to a recording medium (M).

The transfer unit 700 includes an intermediate transfer belt 710 coming in contact with the image carrying members 400Y, 400M, 400C, and 400K and moving like an endless track, a plurality of intermediate transfer rollers 720Y, 720M, 720C, and 720K installed to correspond to the image carrying member s 400Y, 400M, 400C, and 400K, respectively, with the intermediate transfer belt 710 being interposed therebetween, a driving roller 730 rotating to move the intermediate transfer belt 710, a tension roller 740 providing tension to the intermediate transfer belt 710, a final transfer roller 750 installed in a spot of being in contact with the intermediate transfer belt 710 in a transfer route of a recording medium (M), a backup roller 760 backing up the intermediate transfer belt 710 against the final transfer roller 750, and a cleaning unit 770 installed to be in contact with an outside of the intermediate transfer belt 710.

In a printing process, the intermediate transfer belt 710 rotates in a first direction R1 by rotation of the driving roller 730. In FIG. 1, the first direction R1 is expressed as an anticlockwise direction. For one cycle in which the intermediate transfer belt 710 makes one rotation, the respective intermediate transfer rollers 720Y, 720M, 720C, and 720K intermediately transfer visible images by colors on the respective image carrying members 400Y, 400M, 400C, and 400K to an outer surface of the intermediate transfer belt 710 to overlap with one another. Here, the visible images of yellow, magenta, cyan, and black are sequentially intermediately transferred according to a rotating direction of the intermediate transfer belt 710, i.e., the first direction R1.

In other words, while the intermediate transfer belt 710 makes one rotation in the first direction R1, a final color image is formed on the intermediate transfer belt 710. Therefore, in a printing process on one piece of a recording medium (M) by the image forming apparatus 1 in a single-pass method, the intermediate transfer belt 710 does not make two or more rotations in the first direction R1.

The final transfer roller 750 transfers the final color image, intermediately transferred to the intermediate transfer belt 710, to a recording medium (M).

The cleaning unit 770 cleans a waste developing agent or a remaining developing agent on the intermediate transfer belt 710 which is not transferred to a recording medium (M) in the transfer process. The cleaning unit 770 cleans a remaining developing agent on the intermediate transfer belt 710 and collects the remaining developing agent in a separately installed container (not shown).

The transfer unit 700 and the cleaning unit 770 will be described in structure in more detail later.

The fixing unit 800 includes a heating roller 810 generating heat and a pressing roller 820 forming a nip between itself and the heating roller 810. The pressing roller 820 is disposed parallel with the heating roller 810 and pressed by a certain degree of elastic force against the heating roller 810. Accordingly, a nip formed between the heating roller 810 and the pressing roller 820 is given heat and pressure, and an image is fixed while a recording medium (M) on which the image is formed passes the nip.

Figure 2:
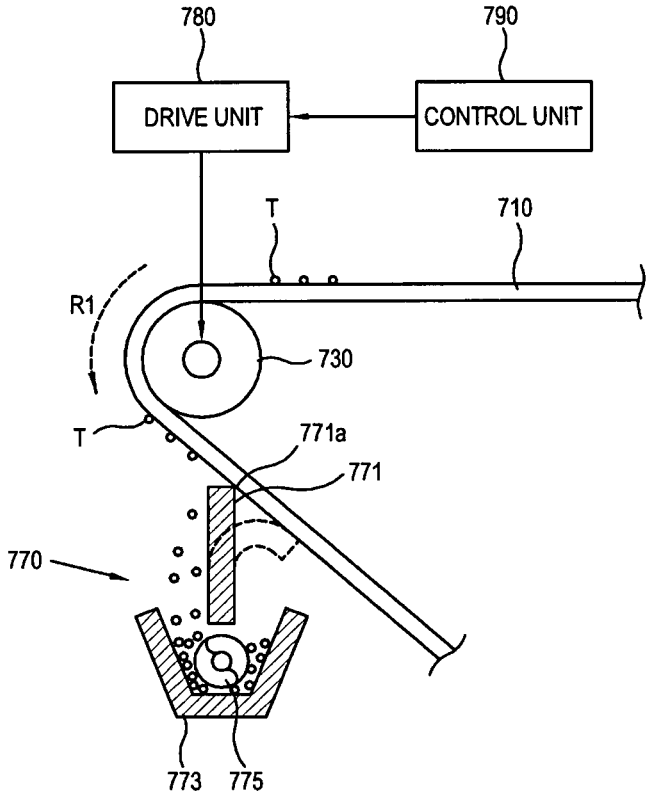
FIGS. 2 and 3 are lateral cross-sectional views of a main part of an intermediate transfer belt and a cleaning blade in the image forming apparatus of FIG. 1.

Hereinafter, the structure of the cleaning unit 770 will be explained in more detail with reference to FIG. 2. FIG. 2 is a lateral cross-sectional view of a main part schematically illustrating the structure of the cleaning unit 770.

As shown in FIG. 2, the cleaning unit 770 includes a cleaning blade 771 having one end portion 771*a* being in contact with the intermediate transfer belt 710 to clean a remaining developing agent (T) on the intermediate transfer belt 710, a chamber 773 extending along the cleaning blade 771 and in which a remaining developing agent (T) cleaned by the cleaning blade 771 is collected, and an auger 775 transferring a developing agent (T) collected in the chamber 773 to a container (not shown) installed in one end portion of the chamber 773.

The cleaning blade 771 extends in a width direction of the intermediate transfer belt 710, and its end portion 771*a* always keeps in contact with the intermediate transfer belt 710 regardless of whether a printing process is performed. The cleaning blade 771 is supported in position by a supporting frame (not shown) separately installed in the body housing 100.

When the intermediate transfer belt 710 rotates in the first direction R1, the end portion 771*a* of the cleaning blade 771, in contact with the intermediate transfer belt 710, slides on an outer surface of the intermediate transfer belt 710 to remove a remaining developing agent (T) on the outer surface. The cleaning blade 771 includes elastically transformable materials such as rubber or urethane, thereby minimally causing damage on the surface of the intermediate transfer belt 710 when cleaning the intermediate transfer belt 710.

Meanwhile, the image forming apparatus 1 includes a drive unit 780 rotating the driving roller 730 and a control unit 790 controlling operation of the drive unit 780 in a printing process.

With this configuration, the control unit 790 controls the drive unit 780 so that the intermediate transfer belt 710 rotates in the first direction R1 in a printing process, thereby intermediately transferring visible images by colors to the intermediate transfer belt 710. Further, while the intermediate transfer belt 710 is rotating in the first direction, the cleaning blade 771 cleans a remaining developing agent (T) on the intermediate transfer belt 710 from a previous printing process.

When a final color image intermediately transferred to the intermediate transfer belt 710 is transferred to a recording medium (M) and a printing process is completed, the control unit 790 stops the intermediate transfer belt 710 rotating.

However, since the intermediate transfer belt 710 is always in contact with the cleaning blade 771, frictional heat occurs on the end portion 771*a* of the cleaning blade 771 due to contact with the rotating intermediate transfer belt 710. Therefore, while a printing process is not conducted and the intermediate transfer belt 710 stops, such frictional heat remains so that the end portion 771*a* of the cleaning blade 771 may delicately adhere to the intermediate transfer belt 710. Instead, properties of materials of the cleaning blade 771 and the intermediate transfer belt 710 may cause fine adhesion in their contact area. Alternatively, at least part of the end portion 771*a* of the cleaning blade 771 may be rolled to the intermediate transfer belt 710 in the first direction.

In this state, if the intermediate transfer belt 710 rotates in the first direction for a next printing process, the cleaning blade 771 may be bent by the intermediate transfer belt 710 in the first direction R1. In this case, a remaining developing agent (T) is not properly cleaned but slipped in one area of the cleaning blade 771 in contact with the intermediate transfer belt 710, and thus the remaining developing agent (T) is left more and more on the intermediate transfer belt 710.

If the remaining developing agent (T) stays on the intermediate transfer belt 710, it is transferred from the intermediate transfer belt 710 rotating in the first direction R1 to a lower part based on the cleaning blade 771, i.e., a position in which intermediate transfer is carried out by the image carrying members 400Y, 400M, 400C, and 400K and the intermediate transfer rollers 720Y, 720M, 720C, and 720K. The remaining developing agent (T) contaminates a final color image and deteriorates image quality on a recording medium (M).

In order to prevent these problems, the image forming apparatus 1 according to the present embodiment arranges the end portion 771*a* of the cleaning blade 771 before performing a printing process, which is explained with reference to FIG. 3.

Figure 3:
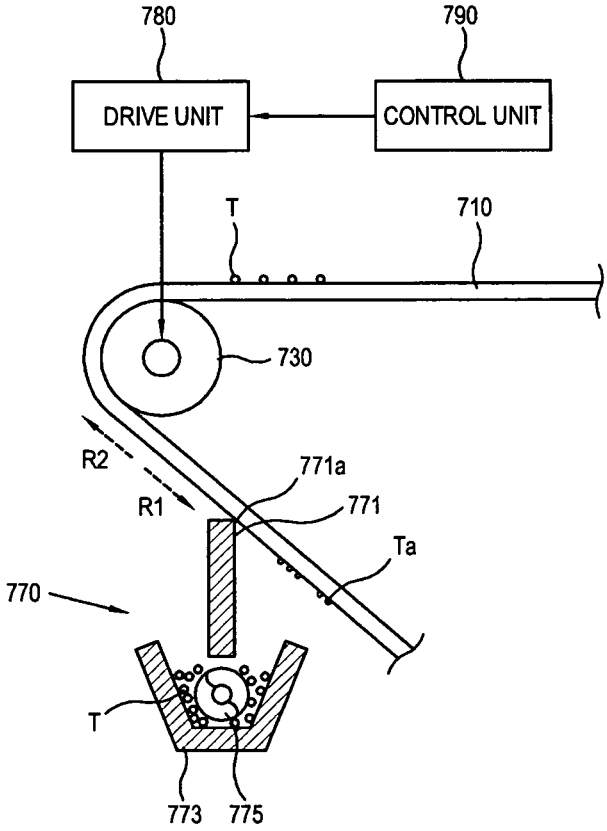

FIG. 3 is a lateral cross-sectional view of the main part showing the control unit 790 controls the drive unit 780 to arrange the end portion of the cleaning blade 771 according to the present embodiment. Here, an initial state is defined as a state that a printing process is not performed and the intermediate transfer belt 710 stops.

As shown in FIG. 3, in the state that the intermediate transfer belt 710 stops, at least part of the end portion 771*a* of the cleaning blade 771 may delicately adhere to the intermediate transfer belt 710 or be rolled to the intermediate transfer belt 710 in the first direction.

When a printing process starts, the control unit 790 controls the drive unit 780 to rotate the intermediate transfer belt 710 in a second direction R2 opposite to the first direction R1 for a preset period of time before visible images on the respective image carrying members 400Y, 400M, 400C, and 400K are intermediately transferred to the intermediate transfer belt 710. The control of the drive unit 780 allows the intermediate transfer belt 710 to rotate in the second direction, so that the end portion 771*a* of the cleaning blade 771 is released from adhesion, or the end portion 771*a* of the cleaning blade 771 rolled to the intermediate transfer belt 710 in the first direction R1 is restored to its original shape.

Here, the preset period of time may be designated differently according to various factors such as properties and use environments of the image forming apparatus 1 and, not limited to specific time, be modified in a designing process. However, as mentioned above, the preset period of time is determined within the range in which releasing the end portion 771*a* of the cleaning blade 771 from adhesion or restoring the end portion 771*a* of the cleaning blade 771 rolled in the first direction R1 to its original state is possible.

After the intermediate transfer belt 710 rotates in the second direction R2 for the preset period of time, the end portion 771*a* of the cleaning blade 771 is expected to be arranged.

Then, the control unit 790 controls the drive unit 780 to rotate the intermediate transfer belt 710 in the first direction R1. Visible images on the respective image carrying members 400Y, 400M, 400C, and 400K are intermediately transferred to the intermediate transfer belt 710 rotating in the first direction R1, and the cleaning blade 771 with the end portion 771*a* arranged by the foregoing process cleans a remaining developing agent (T) on the intermediate transfer belt 710.

As described above, according to the present embodiment, when a printing process starts, the intermediate transfer belt 710 is rotated in an opposite direction for a preset period of time before visible images on the respective image carrying members 400Y, 400M, 400C, and 400K are intermediately transferred, thereby arranging the end portion 771*a* of the cleaning blade 771. Accordingly, in the image forming apparatus 1 in a single-pass method in which the cleaning blade 771 is in contact with the intermediate transfer belt 710 regardless of whether a printing process is performed, the end portion 771*a* of the cleaning blade 771 is arranged to clean a remaining developing agent (T) on the intermediate transfer belt 710.

Meanwhile, a slightly remaining developing agent (Ta) may exist on a lower part of the intermediate transfer belt 710 on the cleaning blade 771 owing to various factors. There may be several reasons why the slightly remaining developing agent (Ta) is left, which may be because a remaining developing agent (T) that is not removed by the cleaning blade 771 stays or a slight developing agent scattered in the body housing 100 adheres.

As aforementioned, when the intermediate transfer belt 710 rotates in the second direction R2, the slightly remaining developing agent (Ta) gets in contact with the cleaning blade 771. The slightly remaining developing agent (Ta) in contact with the end portion 771*a* of the cleaning blade 771 acts like a lubricant between the cleaning blade 771 and the intermediate transfer belt 710, thereby preventing excessive friction occurring.

Figure 4:
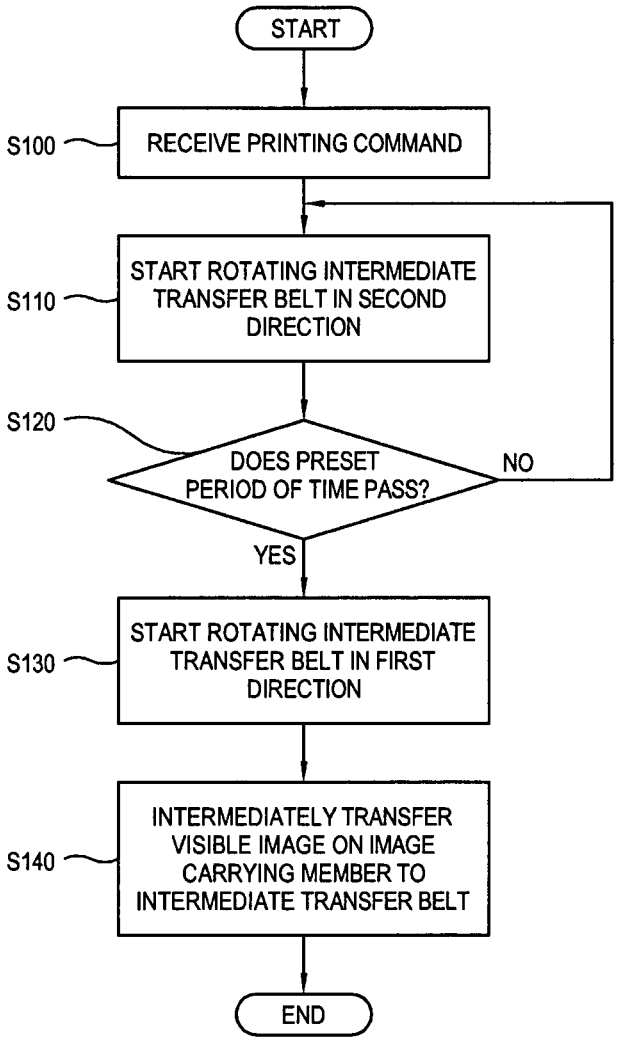
FIG. 4 is a flow chart illustrating a method of controlling the image forming apparatus of FIG. 1.

Hereinafter, a method of controlling the image forming apparatus 1 according to the present embodiment will be described with reference to FIG. 4. FIG. 4 is a flow chart illustrating the process.

As shown in FIG. 4, when receiving a printing command directing a printing process (S100), the control unit 790 starts rotation of the intermediate transfer belt 710 in the opposite direction, i.e., the second direction R2 (S110). Accordingly, the cleaning blade 771 is released from an adhesion or rolled state, so that the end portion 771*a* of the cleaning blade 771 is arranged.

The control unit 790 determines whether the rotation of the intermediate transfer belt 710 in the second direction is made for a preset period of time (S120). If the preset period of time passes, the control unit 790 starts rotation of the intermediate transfer belt 710 in the opposite direction, i.e., the first direction (R1) (S130).

As the intermediate transfer belt 710 rotates in the first direction (R1), visible images on the respective image carrying members 400Y, 400M, 400C, and 400K are intermediately transferred to the intermediate transfer belt 710 and a printing process is carried out (S140).

With this process, the end portion 771*a* of the cleaning blade 771 may be arranged.

Meanwhile, if a printing process is continually conducted on a plurality of recording media (M), a point before a visible image corresponding to each recording medium (M) is intermediately transferred happens to every recording medium (M). Controlling rotation of the intermediate transfer belt 710 in the opposite direction to arrange the cleaning blade 771 may be carried out every point to each recording medium (M) or every preset cycle.

Figure 5A:
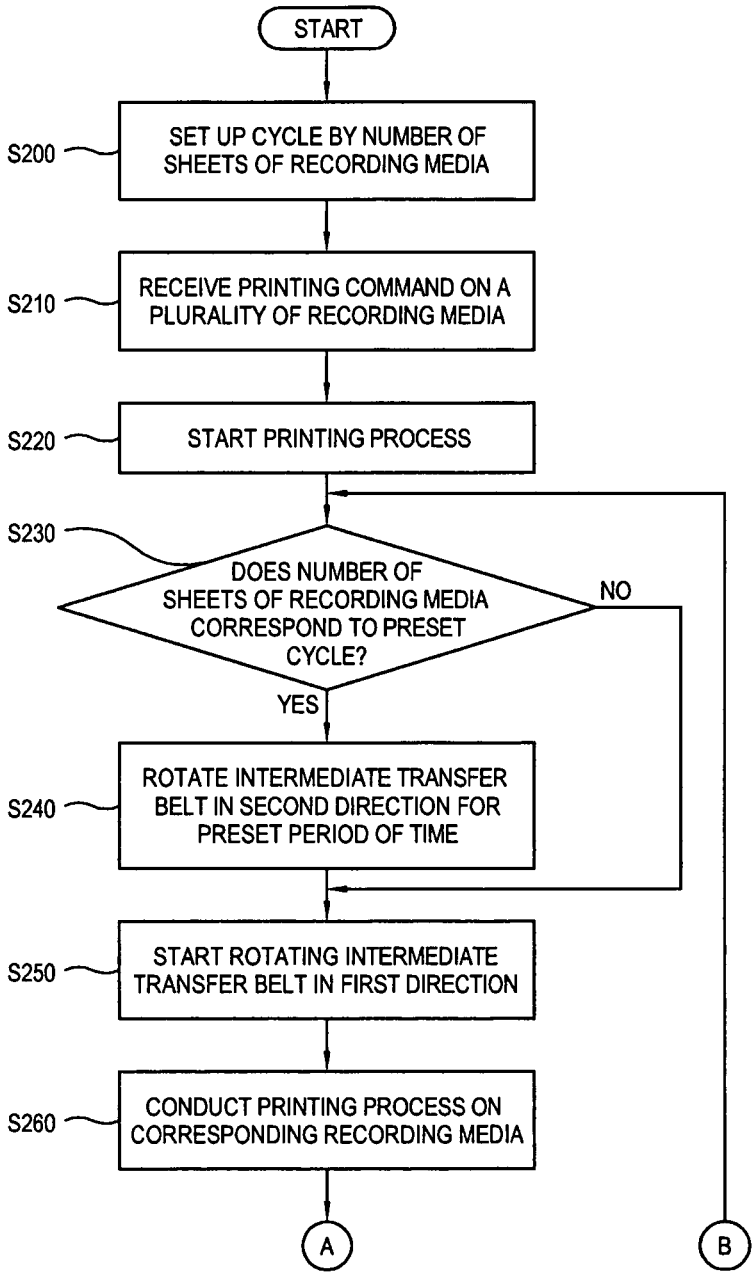
FIG. 5A and FIG. 5B are flow charts illustrating an illustrative example of controlling a printing process of a plurality of recording media in the image forming apparatus of FIG. 1.
Figure 5B:
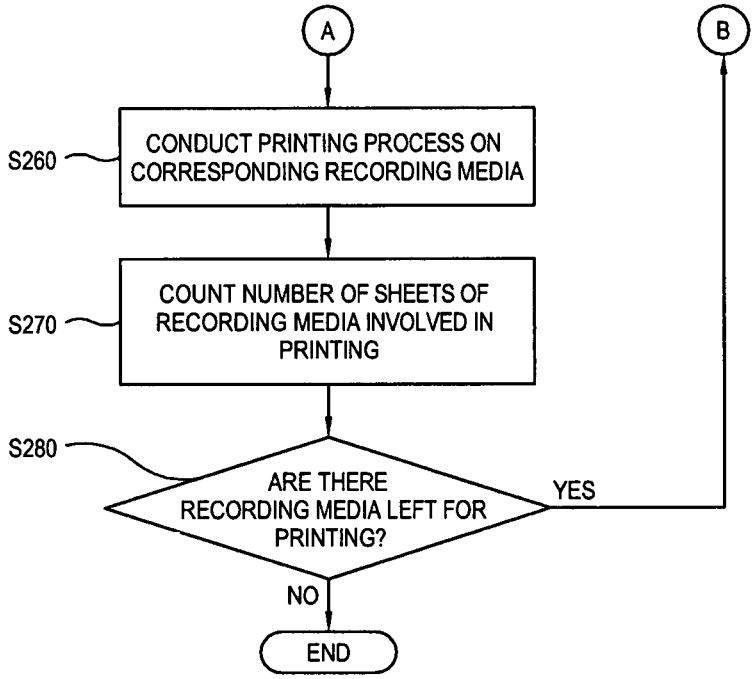

In the following, a control method in the latter case will be explained with reference to FIG. 5A and FIG. 5B. FIG. 5A and FIG. 5B are flow charts illustrating the process.

As shown in FIG. 5A and FIG. 5B, a user may set up a cycle by the sheets of recording media (M) through an input unit (not shown) of the image forming apparatus 1, or the cycle may be set as a default in a manufacturing process (S200).

When receiving a printing command on a plurality of recording media (M) (S210), a printing process on each recording medium (M) is started (S220).

The control unit 790 identifies the number of sheets of recording media (M) for an object to be printed among the total number, and the number of sheets corresponds to the cycle set up at S200 (S230).

As a result, if the number of sheets of recording media (M) for the object corresponds to the cycle, the control unit 790 rotates the intermediate transfer belt 710 in the second direction (R2) for a preset period of time to arrange the end portion 771*a* of the cleaning blade 771 (S240). Then, the control unit 790 starts rotating the intermediate transfer belt 710 in the first direction (R1) (S250).

Meanwhile, if the number of sheets of recording media (M) for the object does not correspond to the cycle as a result of the determination, the control unit 790 does not conduct stage S240 but starts rotating the intermediate transfer belt 710 in the first direction (R1) (S250).

As the intermediate transfer belt 710 rotates in the first direction (R1), a printing process on the corresponding recording media (M) is performed (S260).

The control unit 790 counts the number of sheets of recording media (M) which have been involved in the printing process (S270) and determines whether there are recording media (M) left for printing (S280). If there are recording media (M) left for printing, the foregoing process is repeated.

Accordingly, when printing on a number of sheets of recording media (M) corresponding to the preset cycle among the total sheets of recording media (M), the cleaning blade 771 is arranged.

Meanwhile, the foregoing embodiment has been explained with a structure of rotating the intermediate transfer belt 710 in the opposite direction for a preset period of time without separately providing a sensing unit (not shown) detecting whether the cleaning blade 771 is arranged. However, in another exemplary embodiment, a sensing unit (not shown) detects whether the cleaning blade 771 is arranged, and accordingly the intermediate transfer belt 710 may be controlled in rotation.

For example, a sensing unit (not shown) may be realized by a decompression sensor installed along the end portion 771*a* of the cleaning blade 771, thereby sensing whether the cleaning blade 771 is arranged through a pressure deviation occurring when a portion of the end portion 771*a* is rolled in the first direction. Accordingly to a result of the detection, the control unit 790 may rotate the intermediate transfer belt 710 in the opposite direction if the cleaning blade 771 needs arranging, or may rotate the intermediate transfer belt 710 in the normal direction if detecting that the cleaning blade 771 is arranged. However, this is only an illustrative example and may be modified in design variously.

According to the present embodiment, in an image forming apparatus in a single-pass method which has a cleaning blade keeping in contact with an intermediate transfer belt, when a printing process starts, the intermediate transfer belt is rotated in an opposite direction for a preset period of time, so that the cleaning blade which delicately adheres to the intermediate transfer belt is released, or the cleaning blade rolled in a normal rotation direction of the intermediate transfer belt is restored to the original shape. Accordingly, the cleaning blade is not bent while the printing process is conducted, thereby preventing deterioration in efficiency of cleaning a remaining developing agent on the intermediate transfer belt.

Further, as the efficiency of cleaning the remaining developing agent is prevented from deteriorating, quality of an image formed on a recording medium is secured.

In addition, the intermediate transfer belt is rotated in an opposite direction to enable a contact end portion of the cleaning blade to be easily arranged. Thus, an additional driver is not installed in order to get the cleaning blade in contact with or spaced from the intermediate transfer belt, making it possible to arrange the contact end portion of the cleaning blade.

Finally, the rotation of the intermediate transfer belt in the opposite direction enables a developing agent which is not cleaned or scattered to be on the intermediate transfer belt to be in contact with the cleaning blade, so that the developing agent acts like a lubricant between the cleaning blade and the intermediate transfer belt to reduce frictional heat.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. An image forming apparatus comprising:

a body housing;

an image carrying member supported in the body housing and forming a visible image by a developing agent;

a transfer unit comprising a driving roller supported in the body housing and an intermediate transfer belt rotated by the driving roller in a first direction, the visible image on the image carrying member being intermediately transferred to the intermediate transfer belt when a printing process is conducted on a recording medium;

a cleaning blade having an end portion keeping in contact with the intermediate transfer belt and cleaning a remaining developing agent on the intermediate transfer belt rotating in the first direction;

a drive unit to rotatively drive the driving roller; and a control unit to control the drive unit to rotate the intermediate transfer belt in a second direction to the first direction, the second direction being opposite to the first direction, for a preset period of time before the visible image is intermediately transferred and to rotate the intermediate transfer belt in the first direction so that the visible image is intermediately transferred when the printing process starts, wherein the preset period of time is provided so that the end portion of the cleaning blade is restored to the original shape from the state that at least part of the end portion of the cleaning blade is rolled to the intermediate transfer belt in the first direction.

2. The image forming apparatus according to claim 1, wherein the cleaning blade keeps in contact with the intermediate transfer belt regardless of whether the printing process is conducted.

3. The image forming apparatus according to claim 1, wherein the preset period of time is provided so that at least part of the end portion of the cleaning blade is released from an adhesion state to the intermediate transfer belt.

4. The image forming apparatus according to claim 1, wherein the printing process is carried out on a plurality of recording media, and the control unit rotates the intermediate transfer belt in the second direction when the printing process is carried out on a number of sheets of recording media corresponding to a cycle among a total sheets of the recording media.

5. The image forming apparatus according to claim 1, wherein a plurality of image carrying members are provided by colors, and visible images by colors on the respective image carrying members are sequentially overlapped on the intermediate transfer belt to form a color visible image in the printing process.

6. A method of controlling an image forming apparatus having a transfer unit comprising a driving roller and an intermediate transfer belt rotated by the driving roller in a first direction, a visible image on an image carrying member being intermediately transferred to the intermediate transfer belt when a printing process is conducted on a recording medium; and a cleaning blade having an end portion keeping in contact with the intermediate transfer belt and cleaning a remaining developing agent on the intermediate transfer belt rotating in the first direction, the method comprising:

rotating the intermediate transfer belt in a second direction to the first direction, the second direction being opposite to the first direction, for a preset period of time before the visible image is intermediately transferred when the printing process starts; and conducting the printing process by rotating the intermediate transfer belt in the first direction so that the visible image is intermediately transferred, wherein the preset period of time is provided so that the end portion of the cleaning blade is restored to the original shape from the state that at least part of the end portion of the cleaning blade is rolled to the intermediate transfer belt in the first direction.

7. The method according to claim 6, further comprising keeping the cleaning blade in contact with the intermediate transfer belt regardless of whether the printing process is conducted.

8. The method according to claim 6, wherein the preset period of time is provided so that at least part of the end portion of the cleaning blade is released from an adhesion state to the intermediate transfer belt.

9. The method according to claim 6, wherein the printing process is carried out on a plurality of recording media, and the rotating the intermediate transfer belt in the second direction comprises rotating the intermediate transfer belt in the second direction when the printing process is carried out on a number of sheets of recording media corresponding to a cycle among a total sheets of the recording media.

10. The method according to claim 6, wherein a plurality of image carrying members are provided by colors, and the conducting the printing process comprises forming a color visible image by sequentially overlapping visible images by colors on the respective image carrying members on the intermediate transfer belt.

* * * * *